US007066538B2

(12) United States Patent
Machael et al.

(10) Patent No.: US 7,066,538 B2
(45) Date of Patent: Jun. 27, 2006

(54) CHAIR WITH TILT LOCK MECHANISM

(75) Inventors: Jay R. Machael, Muscatine, IA (US); Randy L. Popham, Durant, IA (US); Jesse J. Hahn, Cedar Rapids, IA (US)

(73) Assignee: HNI Technologies, Inc., Muscatine, LA (US)

( * ) Notice: Subject to any disclaimer, the term of this patent is extended or adjusted under 35 U.S.C. 154(b) by 0 days.

(21) Appl. No.: 10/749,009

(22) Filed: Dec. 30, 2003

(65) Prior Publication Data

US 2005/0140194 A1 Jun. 30, 2005

(51) Int. Cl.
*A47C 1/024* (2006.01)

(52) U.S. Cl. ..... 297/300.2; 297/301.7; 297/302.7; 297/463.1; 297/325; 297/327

(58) Field of Classification Search ..... 297/300.1, 297/300.4, 302.1, 302.3, 300.8, 325, 327, 297/326, 352, 302.7, 300.2, 301.7
See application file for complete search history.

(56) References Cited

U.S. PATENT DOCUMENTS

| | | | | |
|---|---|---|---|---|
| 4,383,714 | A * | 5/1983 | Ishida | 297/325 |
| 4,494,795 | A * | 1/1985 | Roossien et al. | 297/362.14 |
| 4,892,354 | A * | 1/1990 | Estkowski et al. | 297/303.3 |
| 5,333,368 | A * | 8/1994 | Kriener et al. | 297/302.1 |
| 5,340,194 | A * | 8/1994 | Neumuller | 297/301.3 |
| 5,658,045 | A * | 8/1997 | Van Koolwijk et al. | 297/300.5 |
| 5,765,914 | A * | 6/1998 | Britain et al. | 297/300.4 |
| 5,810,439 | A * | 9/1998 | Roslund, Jr. | 297/300.4 |
| 6,012,774 | A * | 1/2000 | Potter | 297/325 |
| 6,102,477 | A * | 8/2000 | Kurtz | 297/301.7 |
| 6,286,900 | B1 * | 9/2001 | Roark | 297/300.8 |
| 6,588,845 | B1 * | 7/2003 | Wilkerson et al. | 297/300.2 |
| 6,685,267 | B1 * | 2/2004 | Johnson et al. | 297/300.1 |

* cited by examiner

*Primary Examiner*—Peter M. Cuomo
*Assistant Examiner*—Erika Garrett
(74) *Attorney, Agent, or Firm*—Faegre & Benson LLP

(57) ABSTRACT

A tiltable chair is provided with a tilt lock mechanism that can be activated when the chair is at any tilt position, the tilt lock mechanism engaging and locking the chair when the chair moves into the upright, neutral position.

10 Claims, 15 Drawing Sheets

CHAIR WITH TILT LOCK MECHANISM

CROSS-REFERENCE TO RELATED APPLICATION

Cross-reference is made to the patent applications "Chair with Backward and Forward Passive Tilt Capabilities," Ser. No. 10/749,008; "Horizontally Adjustable Chair Arm Rest," Ser. No. 10/748,537; "Chair Back with Improved Resilience and Support," Ser. No. 10/750,576; "Vertically Adjustable Chair Arm Rest," Ser. No. 10/749,010; and "Chair with Adjustable Seat Depth," Ser. No. 10/748,079; each filed on even date herewith and each incorporated herein by reference in its entirety.

BACKGROUND OF THE INVENTION

This invention relates to a chair having a tilt mechanism that allows the chair seat and back rest to tilt for the comfort of the user. More particularly, this invention relates to a chair having a tilt mechanism that allows the chair seat and back rest to tilt forwardly and rearwardly for the comfort of the user wherein the chair can be releasably locked in an upright, neutral position.

Many chairs, particularly office chairs, have weight activated backward tilt. By this it is meant that a user's weight exerts a force on the chair seat that is transferred through mechanical links to the chair back is able to tilt the back portion of the chair to a reclining position. When the user shifts his/her weight back to an upright posture, or when the user departs, the chair returns to is neutral position on its own. This phenomenon is often described as being "passive," as opposed to a chair in which a user operates a lever to tilt the chair. When the user shifts his/her weight forward, a spring returns the back portion of the chair to its upright position. Some office chairs are arranged so that the seat portion also moves in response to tilting of the back portion. Sometimes the seat portion is fixed to the back portion so that they pivot about the same angle. In other chairs, commonly known in the industry as "synchro-tilt" chairs, the seat portion is arranged to be lowered or raised at a different rate than the rate of decline of the back portion, resulting in different angular movements of the back portion and the seat portion.

While many users prefer passive tilt capability in an office chair, some users prefer that the chair remain in its upright neutral position at all times. Still other users prefer to have an office chair with passive tilt capability for most tasks, but prefer to be able to lock the chair in its upright, neutral position for certain tasks or at certain times.

It is thus one object of the invention to provide a chair for use in an office or like environment and having a passive weight activated synchro-tilt mechanism, the chair comprising a tilt lock assembly by which the user can lock the chair in an upright, neutral position to prevent such forward and rearward tilting, at such times and under such circumstances as the user desires.

SUMMARY OF THE INVENTION

A chair is provided having backward and forward passive tilt capabilities, the chair comprising a seat assembly, a back assembly, a frame for supporting the seat assembly and back assembly, a synchro-tilt mechanism, and in accordance with the invention, a tilt lock assembly that can be engaged by the user to operate on the seat assembly and prevent forward or backward tilting of the seat assembly, thus maintaining the seat assembly in the upright neutral position. The synchro-tilt mechanism synchronizes motion of the back assembly with that of the seat assembly so that when the seat assembly can not tilt, the back assembly also cannot tilt. The tilt lock assembly can be disengaged by the user, allowing the chair to assume its full range of tilting motion. Specifically, the tilt lock assembly comprises a lock member, a lock engagement member, and operating means for engaging and disengaging the lock engagement member from the lock member. When the lock engagement member is engaged with the lock member, then the seat assembly is fixed in a first neutral, upright orientation. When the lock engagement member is disengaged from the lock member, then the seat assembly can pivot in a backward and forward motion.

In one embodiment of the invention, the lock member comprises two portions in sliding engagement with each other, a lower portion being in sliding engagement with respect to the seat frame and having receiving means formed therein, and an upper portion operatively connected to the seat assembly. The sliding engagement between the first and second portions of the lock member allows further relative movement of the seat assembly with respect to the seat frame for the further comfort and convenience of the user. In another embodiment of the invention, each lock member can be a single member, and two such lock members can be employed to provide greater strength and durability to the tilt lock assembly of the invention.

DESCRIPTION OF THE FIGURES

The invention will be more readily understood by reference to the accompanying figures wherein.

DETAILED DESCRIPTION OF THE INVENTION

Figure 1:
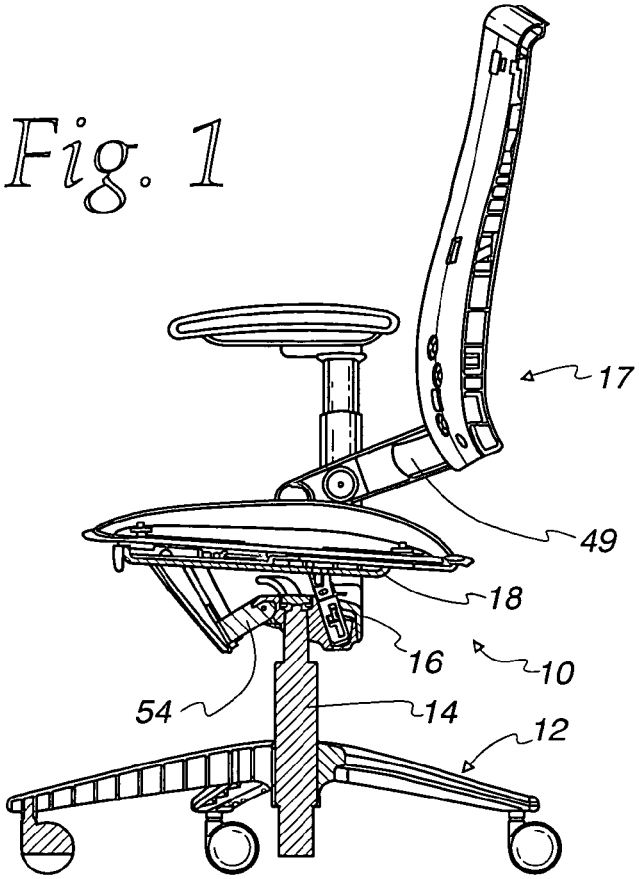
FIG. 1 is a side view of a typical chair style comprising a first embodiment of the instant invention.

As illustrated in the drawings, a chair 10 having an embodiment of the tilt lock assembly of the instant invention can comprise a base 12 from which a central support member 14 extends upwardly. Seat frame 16 is supported by central support member 14, and in turn supports back assembly 17 and seat assembly 18. Tilt lock assembly 19 includes lock member 20 that operatively engages seat frame 16 and seat assembly 18.

Figure 2:
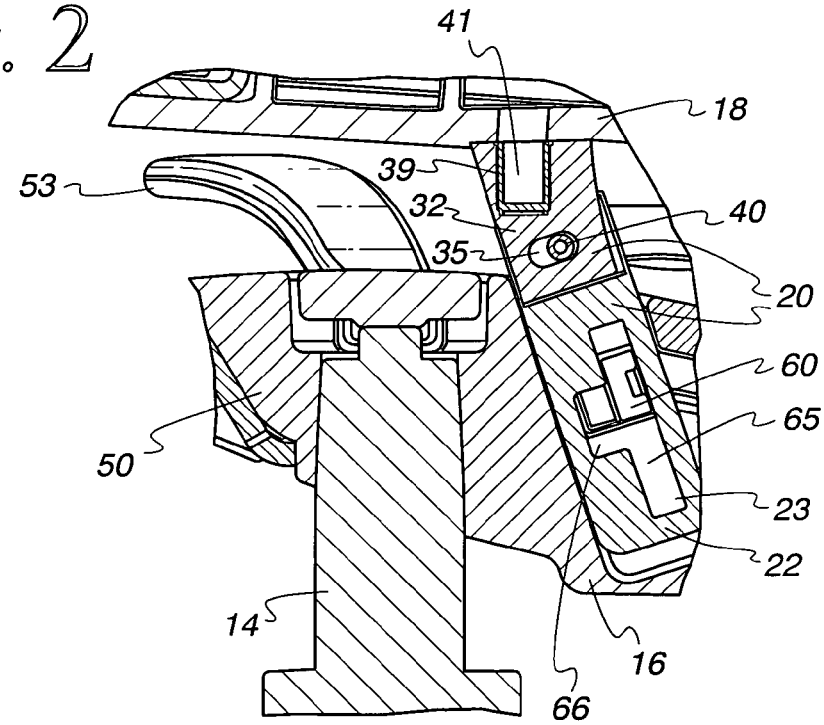
FIG. 2 is a cross section view of a detail of the chair of FIG. 1 showing the structures beneath the seat assembly.
Figure 5:
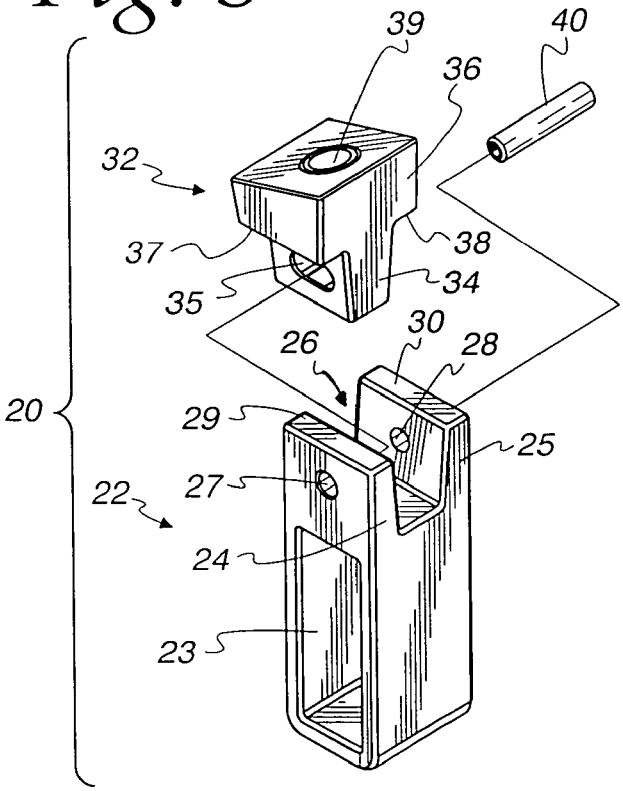
FIG. 5 is an exploded view of the lock member of the FIG. 3.
Figure 6:
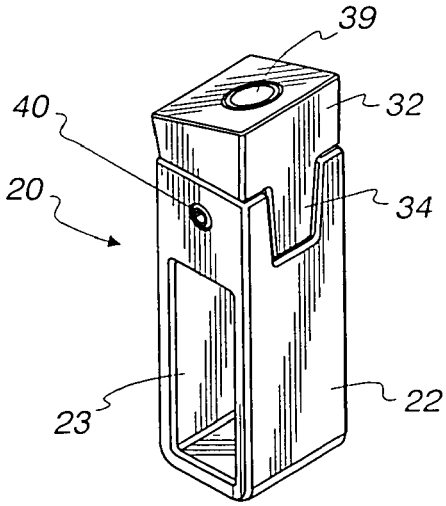
FIG. 6 is an assembled view of the lock member of FIG. 5.

In the embodiment of lock member 20 illustrated in FIGS. 5 and 6, lock member 20 comprises a lower portion 22 and an upper portion 32. Toward one end of lower portion 22 is an aperture 23 for receiving a lock engagement member, described more fully below. As seen in FIG. 2, aperture 23 is generally "T" shaped, comprising a main channel 65 and an associated channel 66 in communication with main channel 65. On the upper end of lower portion 22 are two upwardly extending arms 24, 25, that define therebetween a gap 26. Each arm 24, 25 has extending therethrough an orifice 27, 28, respectively, and terminates at its upper end in a shoulder 29, 30. Preferably, the orifices 27, 28 are substantially circular. Upper portion 32 of lock member 20 comprises a lower depending member 34 sized and dimensioned to fit in sliding engagement within gap 26. Depending member 34 is provided with an elongated slot 35 that aligns with orifices 27, 28 when depending member 34 is fitted within slot 26. A locking pin 40 passes through orifice 28, slot 35, and orifice 27. It may be seen that locking pin 40 within elongated slot 35 limits the sliding motion of upper portion 32 of lock member 20 with respect to lower portion 22 of lock member 20. Upper portion 32 further includes a broader head portion 36 having lower side surfaces 37, 38, that engage shoulders 29, 30 of lower portion 22. The top surface of upper portion 32 is provided with a threaded orifice 39, that receives a threaded connector 41 to the underside of the seat assembly 18.

Figure 3:
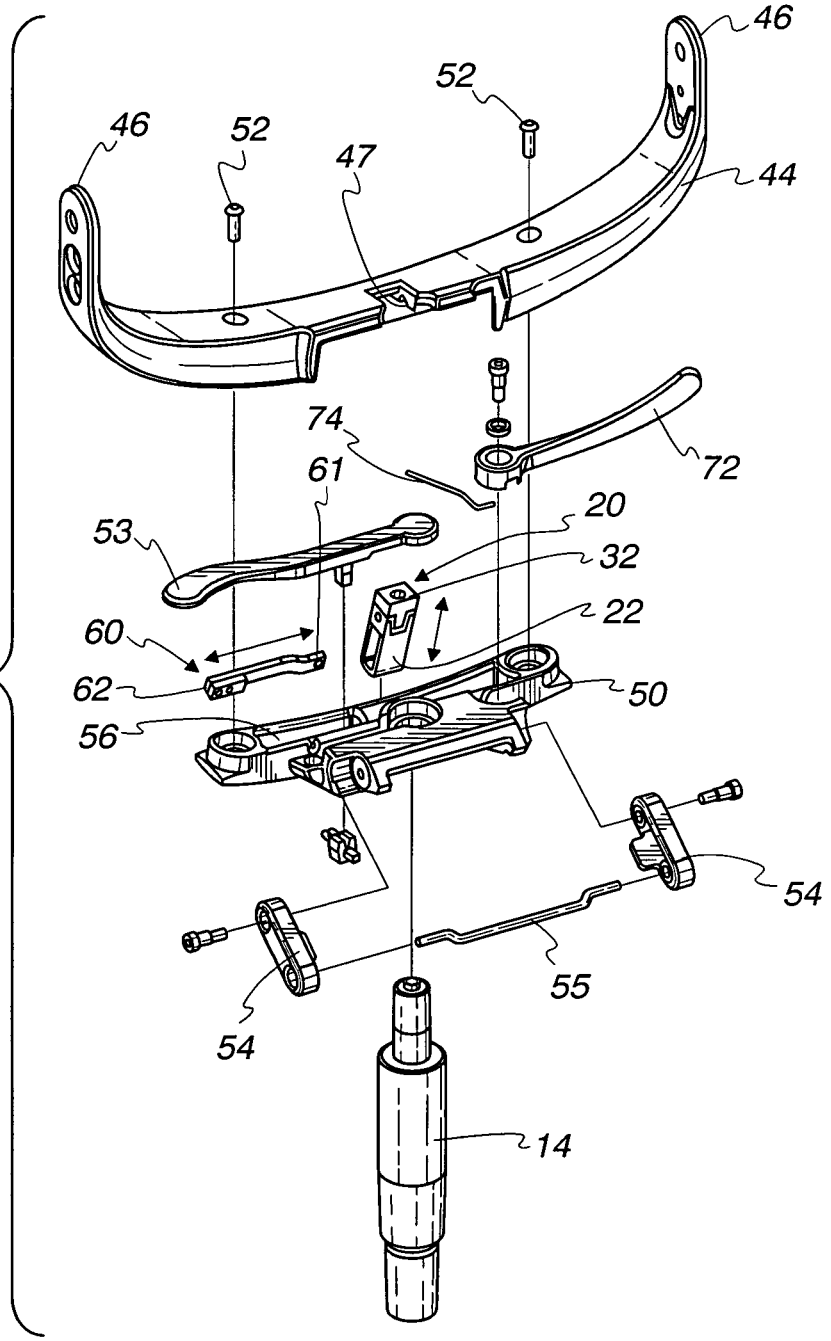
FIG. 3 is an exploded view of the components of the embodiment of the tilt lock assembly of FIG. 1.
Figure 4:
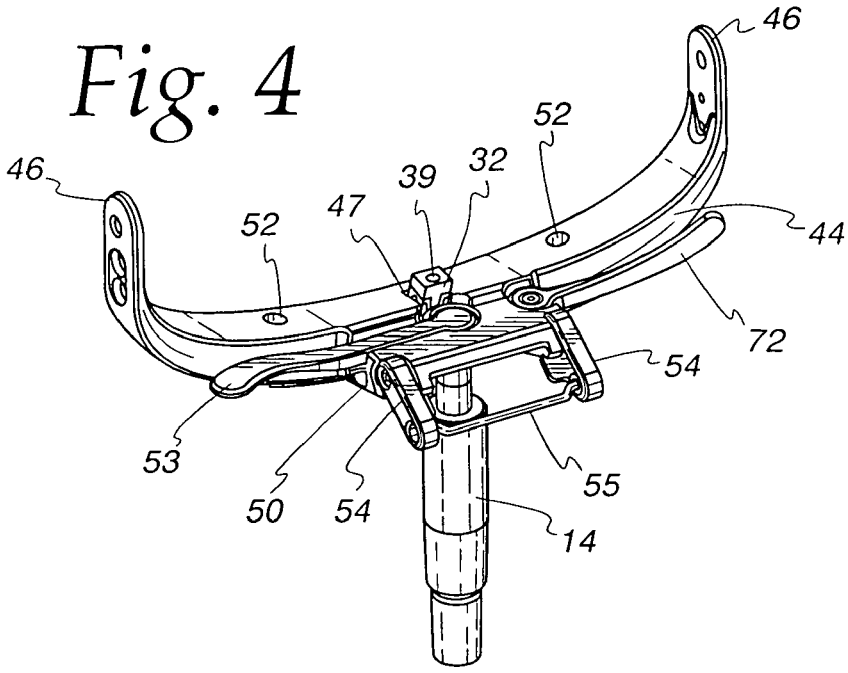
FIG. 4 is an assembled view of the components of FIG. 3

As illustrated in FIGS. 3 and 4, seat frame 16 comprises a yoke member 44 and hub member 50 fixedly secured to one another. For ease of viewing, hub member 50 is shown in FIGS. 1 and 2, but yoke member 44 is not. Hub member 50 is fixedly secured to central support member 14, such that neither hub member 50 nor yoke member 44 moves during tilting of either the back assembly 17 or the seat assembly 18. Yoke member 44 includes two upwardly extending arms 46, each of which is pivotably connected to a link member 49, which link member 49 is connected at its upper end to back assembly 17. Yoke member 44 further includes a channel 47, which receives lock member 20 in sliding engagement.

Yoke member 44 is fixedly secured to hub member 50 by means of fastening elements 52, which can be bolts, screws, or other known equivalent fastener elements. Mounted on hub member 50 is seat height adjustment lever 53, which functions independently of the tilt lock assembly described herein. Also mounted on hub member 50 are two links 54 connected by link shaft 55, the links 54 being connected by other links to seat assembly 18, links 54 functioning in connection with the tilting movement of seat assembly 18. Hub member 50 includes a transverse channel 56, which is sized and dimensioned to accommodate lock engagement member 60. Lock engagement member 60 is illustrated in the form of an elongated bar having a thinner leading end 61 and a thicker trailing end 62. When lock engagement member 60 is installed in transverse channel 56, and yoke member 44 is mounted to hub member 50 with lock member 20 in yoke channel 47, then the thinner leading end 61 of lock engagement member 60 fits within and through aperture 23 of lock member 20. Transverse movement of thinner leading end 61 of lock engagement member 60 within aperture 23 of lock member 20 is controlled by operating means 70. In the illustrated embodiment, operating means 70 comprises a tilt lock lever 72 mounted to hub member 50 and a connecting means that operatively connects the tilt lock lever 72 to lock engagement member 60. As shown in FIG. 3, the connecting means can be a spring wire 74 connected on one end to operating lever 72 and on its other end to leading end 61 of lock engagement member 60.

Figure 7:
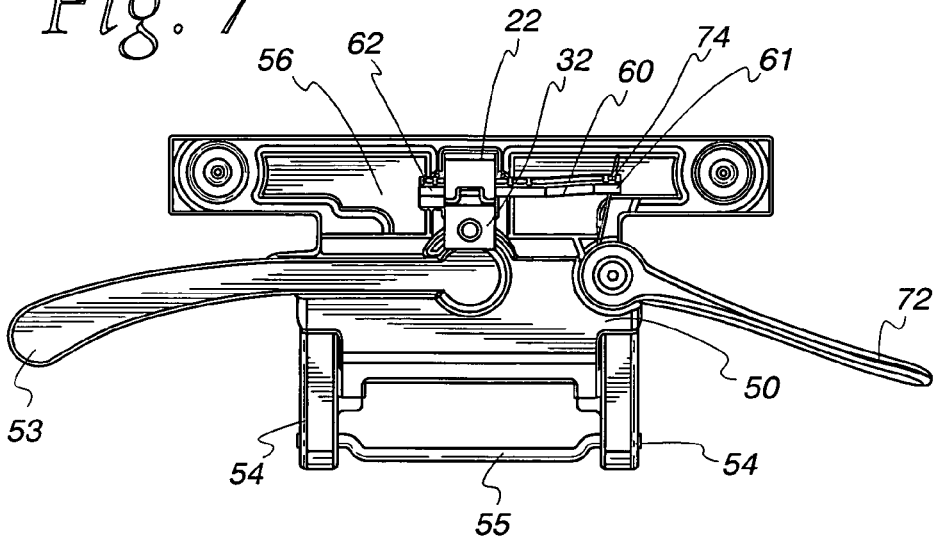
FIG. 7 is a top view of the operating means of the tilt lock assembly of the embodiment of FIGS. 1–6 shown in the locked position.
Figure 8:
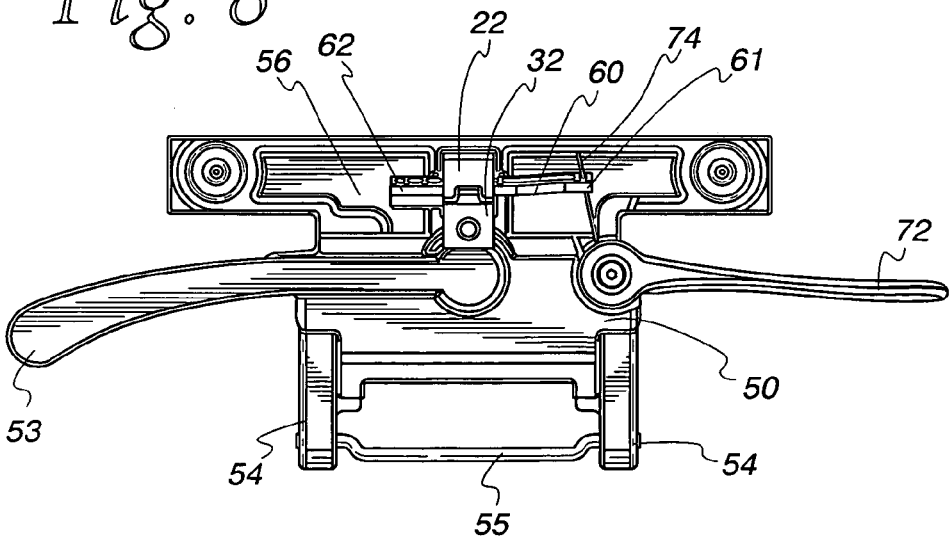
FIG. 8 is a top view of the operating means of the tilt lock assembly of the embodiment of FIGS. 1–6 shown in the unlocked position.
Figure 9:
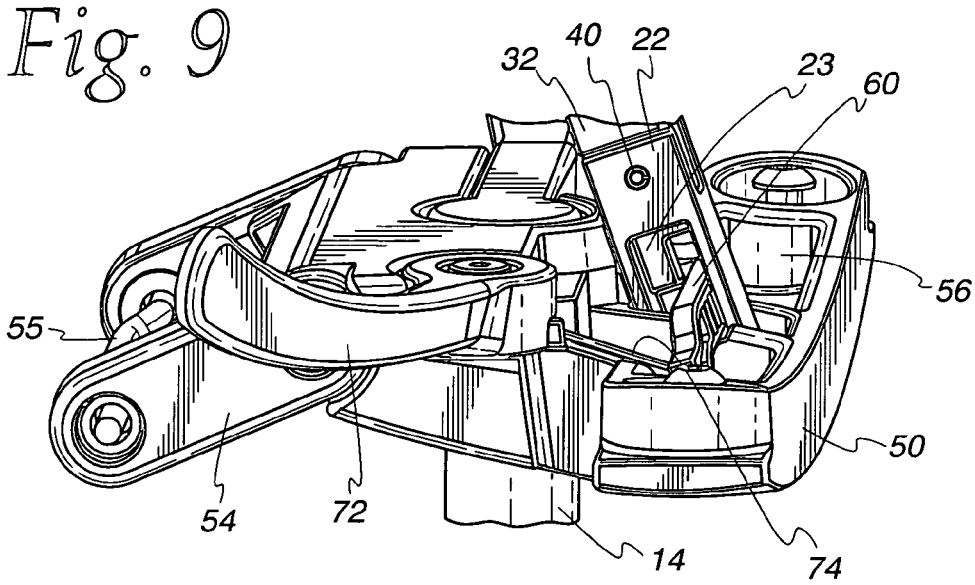
FIG. 9 is a perspective view of the tilt lock assembly of FIGS. 1–6 shown in the locked position.
Figure 10:
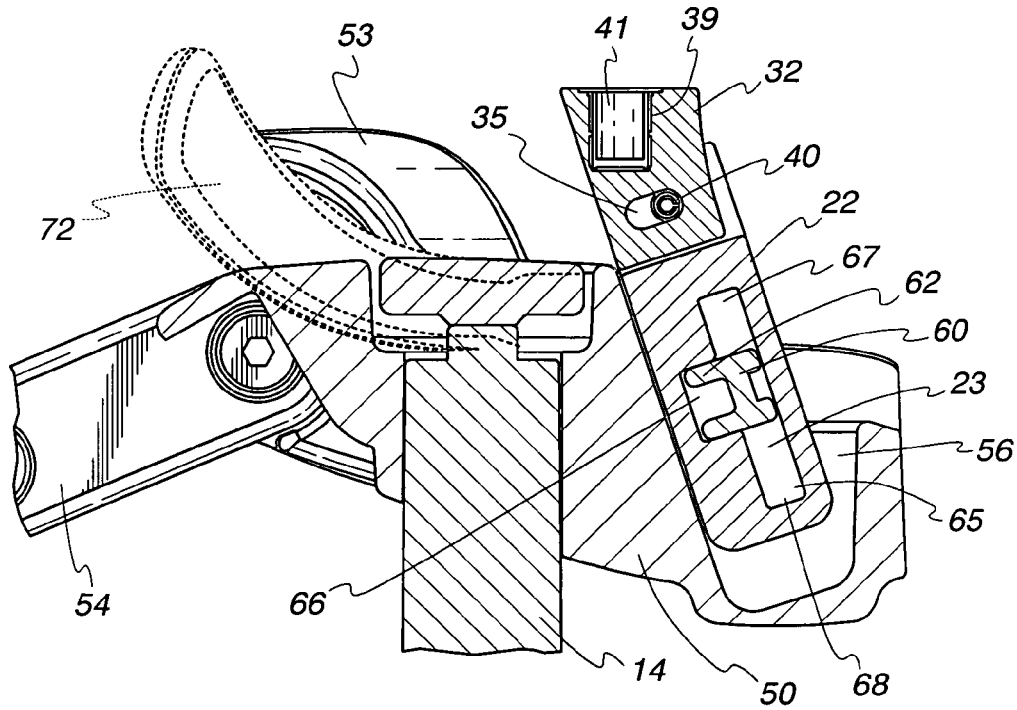
FIG. 10 is a cross-section view of the tilt lock assembly of FIGS. 1–6 shown in the locked position.
Figure 11:
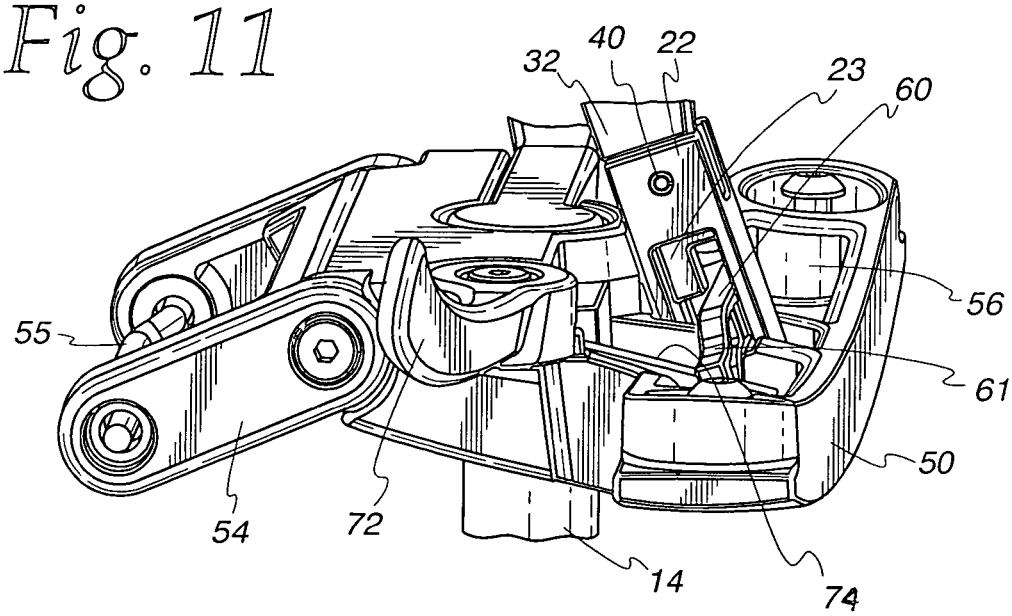
FIG. 11 is a perspective view of the lock mechanism of FIGS. 1–6 shown in the unlocked position.
Figure 12:
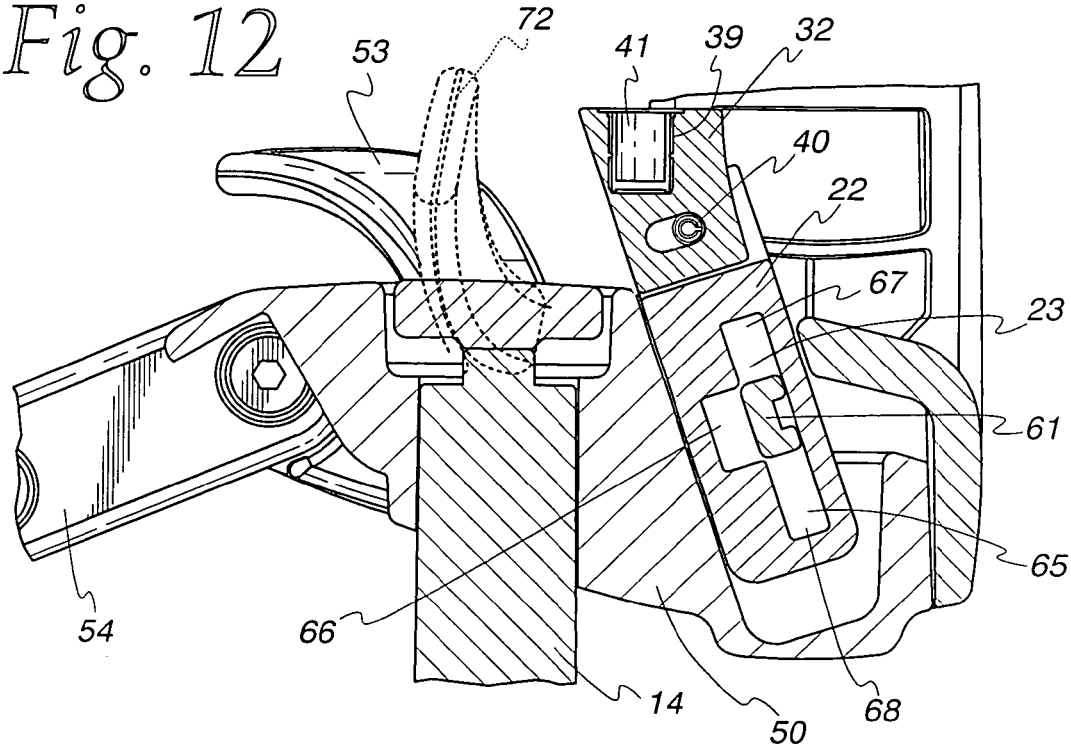
FIG. 12 is a cross-section view of the lock mechanism of FIGS. 1–6 shown in the unlocked position.
Figure 13:
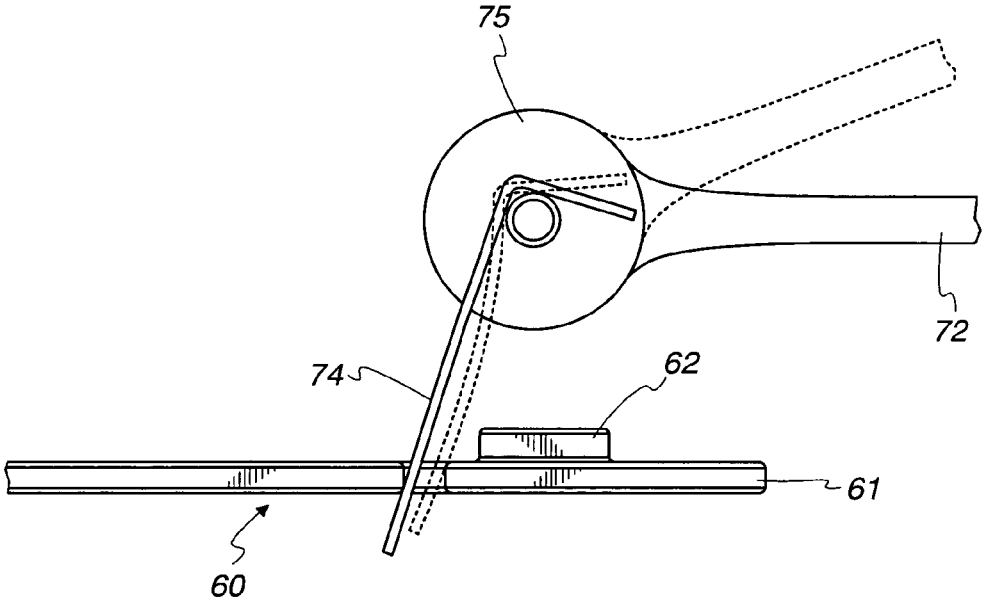
FIG. 13 is a schematic view of the operation of the operating assembly of the present invention.

Operation of the tilt lock assembly of the invention is best understood by reference to FIGS. 7–13. FIGS. 7, 9, and 10 show the tilt lock assembly of the invention in a locked condition. Tilt lock lever 72 has been pulled forward by the user. As shown in FIG. 13, this creates a tension in spring wire 74, which introduces a force on lock engagement member 60 urging lock engagement member 60 in the direction of leading end 61. When the chair 10 is in an unlocked tilted position, then associated channel 66 of aperture 23 may not be aligned with lock engagement member 60, and lock engagement member 60 will not move in response to the force of spring wire 74. When, however, the chair 10 is moved to its neutral position, then associated channel 66 will align with lock engagement member 60, and the force exerted by spring wire 74 will urge lock engagement member 60 in the direction of thinner leading end 61, allowing thicker end 62 to slide into associated channel 66, as shown in FIG. 10. Once thicker end 62 is so engaged in associated channel 66, then main channel 65 of aperture 23 can no longer slide vertically along lock engagement member 60. By virtue of the coupling 41 between upper portion 32 of lock member 20 and seat assembly 18, seat assembly 18 is restrained from moving vertically. If the seat assembly is connected by various linkages to the back assembly, such as in a synchro-tilt chair, then the back assembly also may be prevented from moving. Thus, both the seat assembly and the back assembly are locked in the neutral, upright condition.

If the user desires to disengage the tilt lock assembly of the invention, the user pushes back on the handle 72. Referring to FIGS. 8, 11, 12, and 13, this releases tension on spring wire 74, such that lock engagement member 60 is urged toward its trailing edge, such that the thicker trailing edge 62 is no longer engaged within aperture 23 in general or within associated channel 66 in particular. Only thinner leading edge 61 is disposed within main channel 65 of aperture 23. Thus, lock member 20 is free to move vertically with leading edge 61 disposed within main channel 65, with upper end 67 of main channel 65 and lower end 68 of main channel 65 serving to limit the range of vertical movement of lock member 20, and thus to limit the vertical movement of seat assembly 18.

Figure 14:
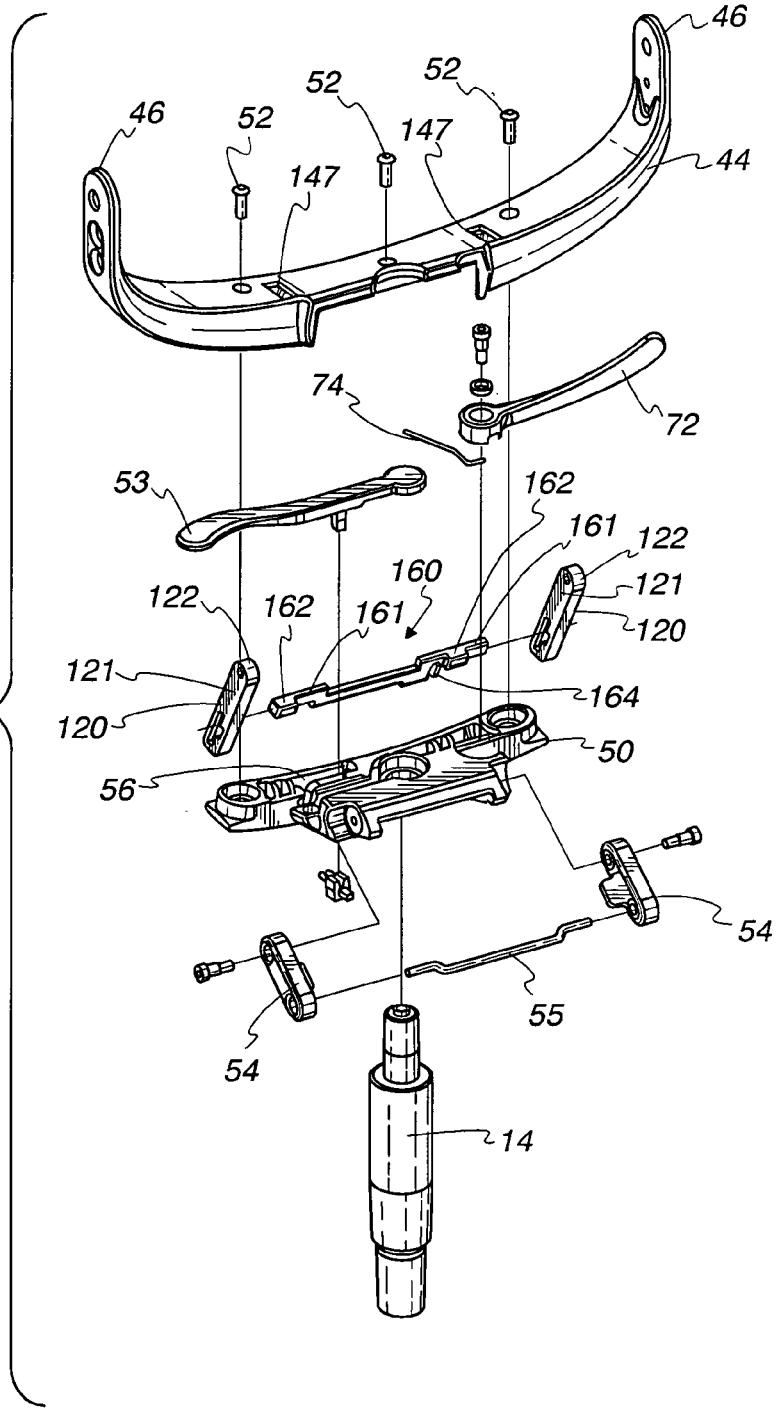
FIG. 14 is an exploded view of a second embodiment of a tilt lock assembly of the instant invention.

A second embodiment of a tilt lock assembly of the instant invention is illustrated in FIGS. 14–21. In this embodiment two lock members are used, rather than one. This design provides enhanced securement of the tilt lock assembly to the seat assembly, and greater structural integrity. Referring to FIG. 14, it may be seen that fastening means 52, seat height adjustment lever 53, tilt lock lever 72, spring wire 74, hub member 50,links 54, link shaft 55, and central support member 14 are all substantially unchanged. Each lock member 120 can be formed of two longitudinal halves 121, 122. Lock members 120 each have a "T" shaped aperture 123 with a main channel 165 and an associated channel 166. Each lock member 120 has an aperture 124 near its top end for securement to seat assembly 18, as described below. Yoke member 44 is provided with two yoke channels 147 to receive the two lock members 120. Lock engagement member 160 comprises two thinner regions 161 and two thicker regions 162.

Figure 15:
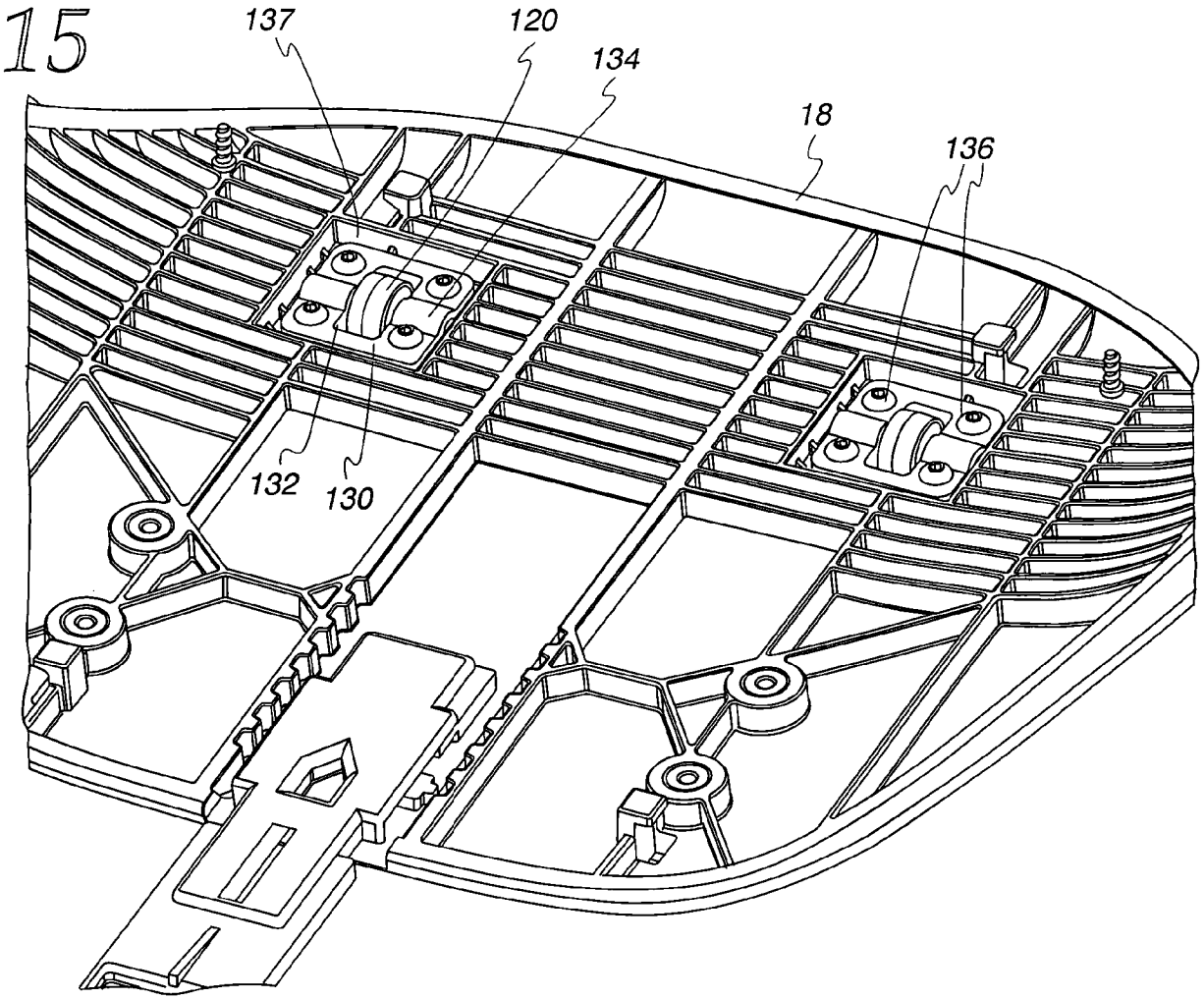
FIG. 15 is a top perspective of a seat plate of a chair having the second embodiment of the invention installed therein.
Figure 16:
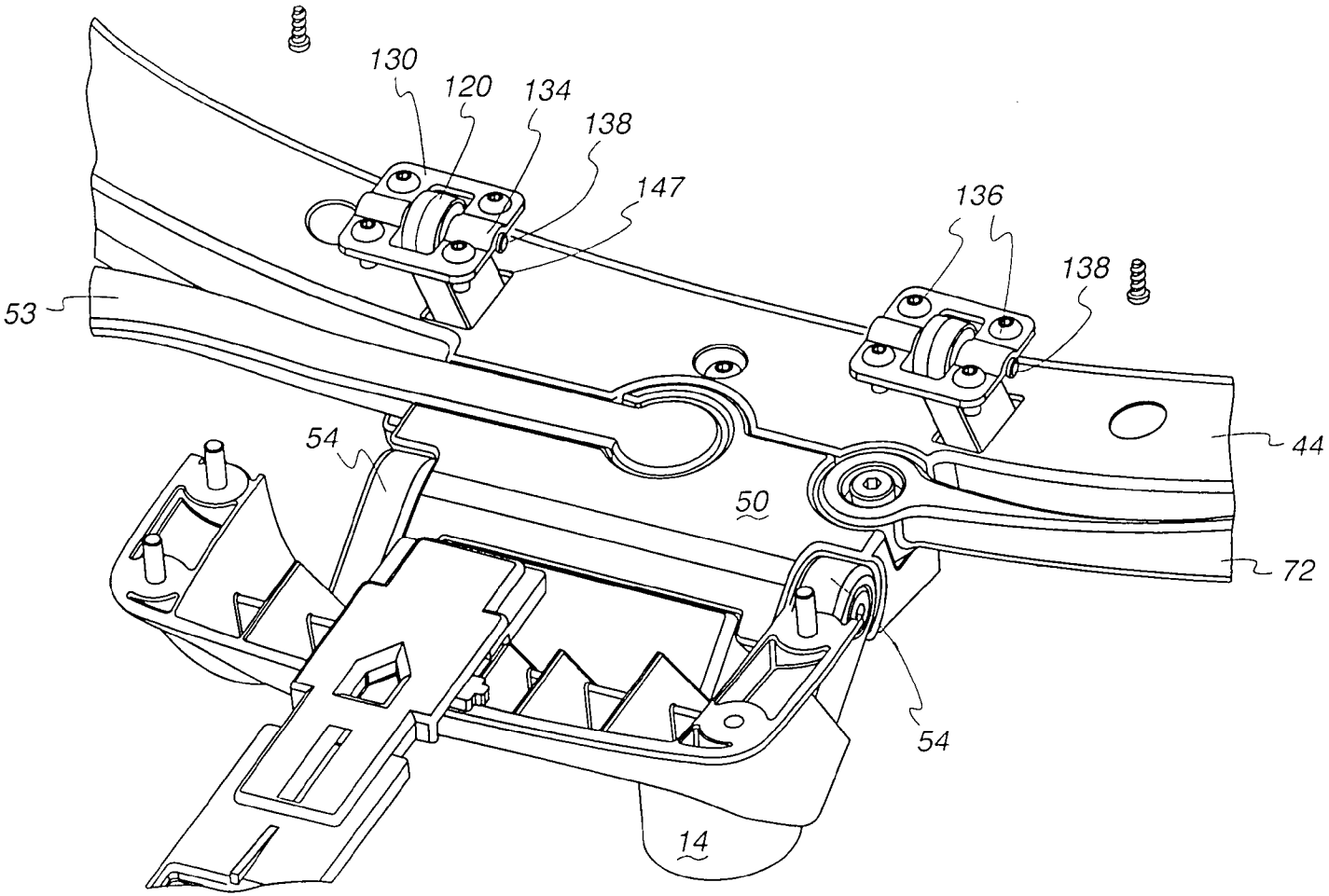
FIG. 16 a the same view as in FIG. 15 but with the seat plate removed.
Figure 17:
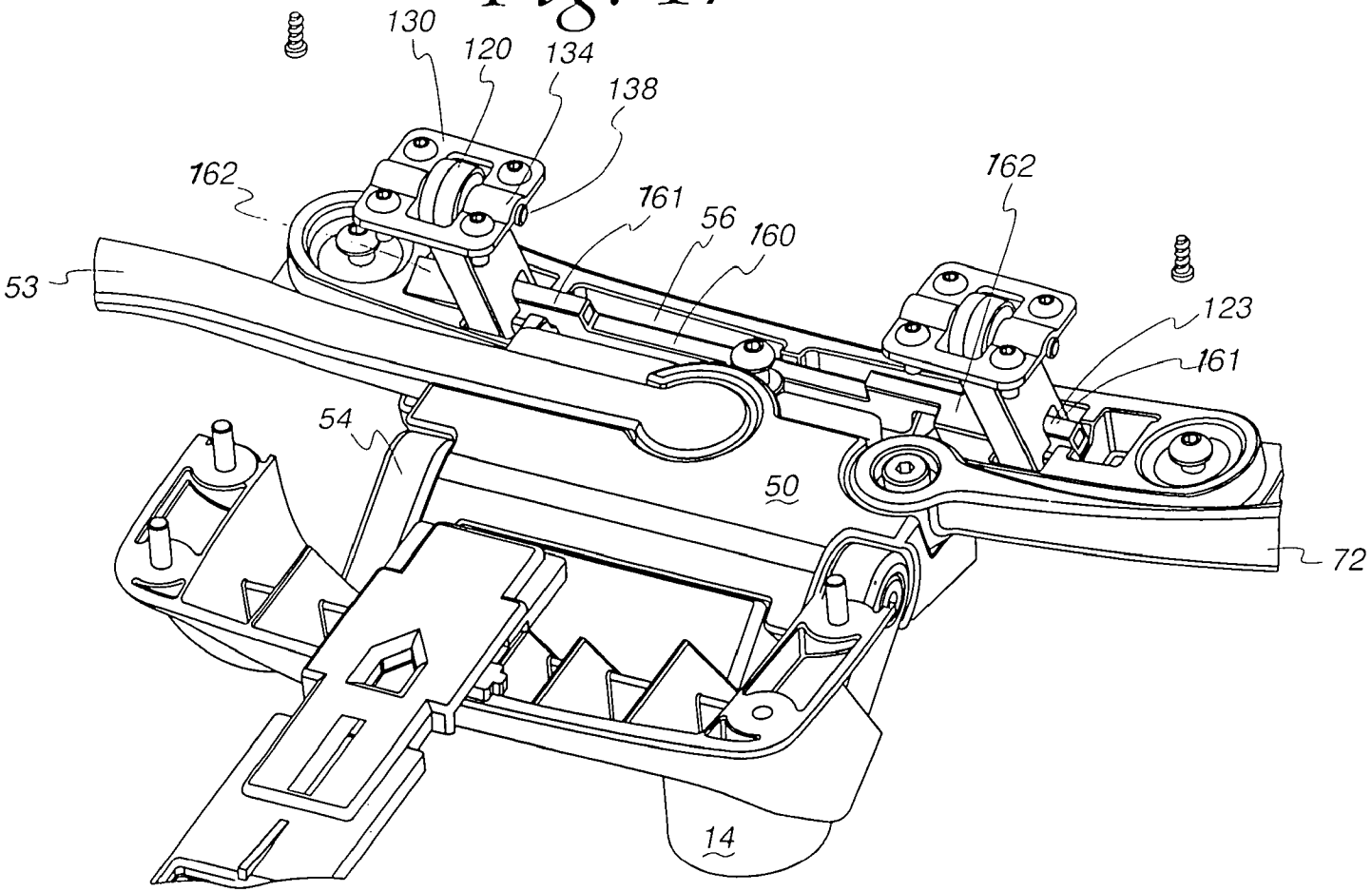
FIG. 17 is the same view as in FIG. 16 but with the yoke member removed.

Referring to FIG. 15, the means for connecting the lock members 120 to seat assembly 18 comprises two plates 130, each plate having a centrally located orifice 132 sized and dimensioned to receive the upper end of lock member 120. On either side of each orifice 132 is a transverse channel 134 of semi-circular cross-section, such that when lock member 120 is received in orifice 132, each channel 134 will be aligned with aperture 124. Each plate 130 is secured to seat assembly 18 by one or more fastening members 136. The seat assembly 18 has wells 137 in which plates 130 are received. Each well has holes, not shown, that receive the lower ends of fastening members 136, and has transverse trenches of semi-circular cross-section, also not shown, that correspond to channels 134. When plates 130 are received in wells 137, the transverse channels and transverse trenches together define a channel of circular cross-section. Pin 138 passes through each such circular channel and through aperture 124 of lock member 24, so that seat assembly 18 is pivotably mounted to lock members 120. Thus as seat assembly 18 tilts in response to movement by a user, lock members 120 will be able to rise and fall as necessary within channels 147 of yoke member 44, as shown in FIG. 16, and within channel 56 of hub member 50, as shown in FIG. 17.

Figure 18:
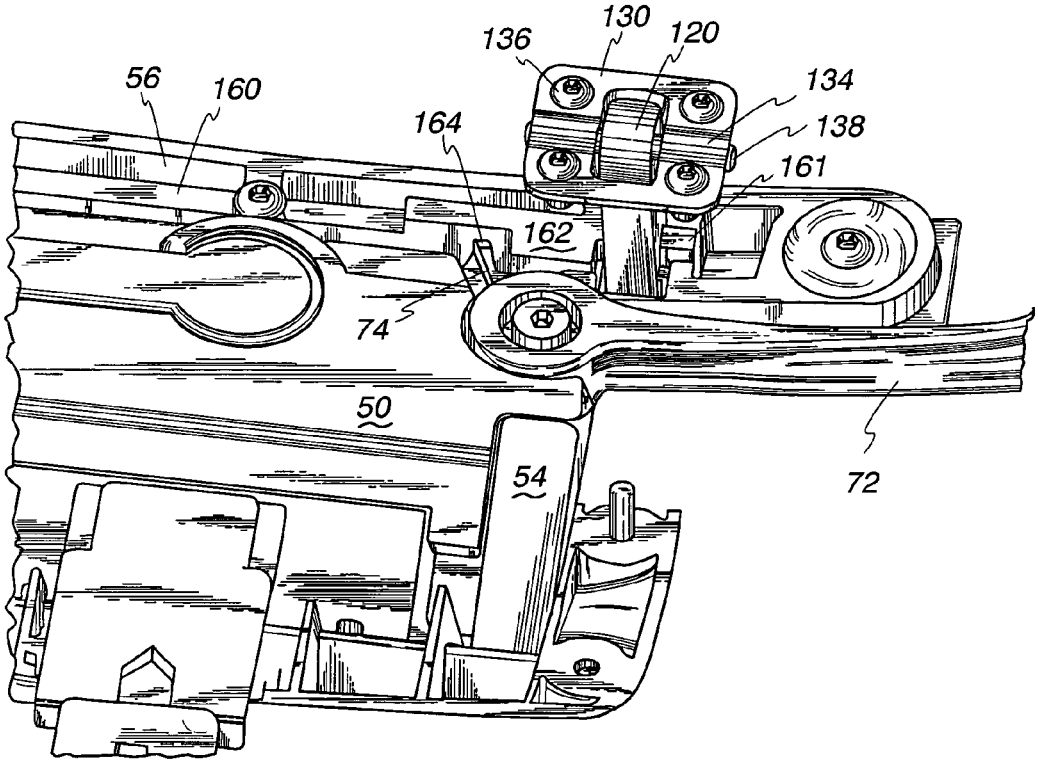
FIG. 18 is the same view as FIG. 17 but showing a close-in view of the operating assembly of the invention.
Figure 19:
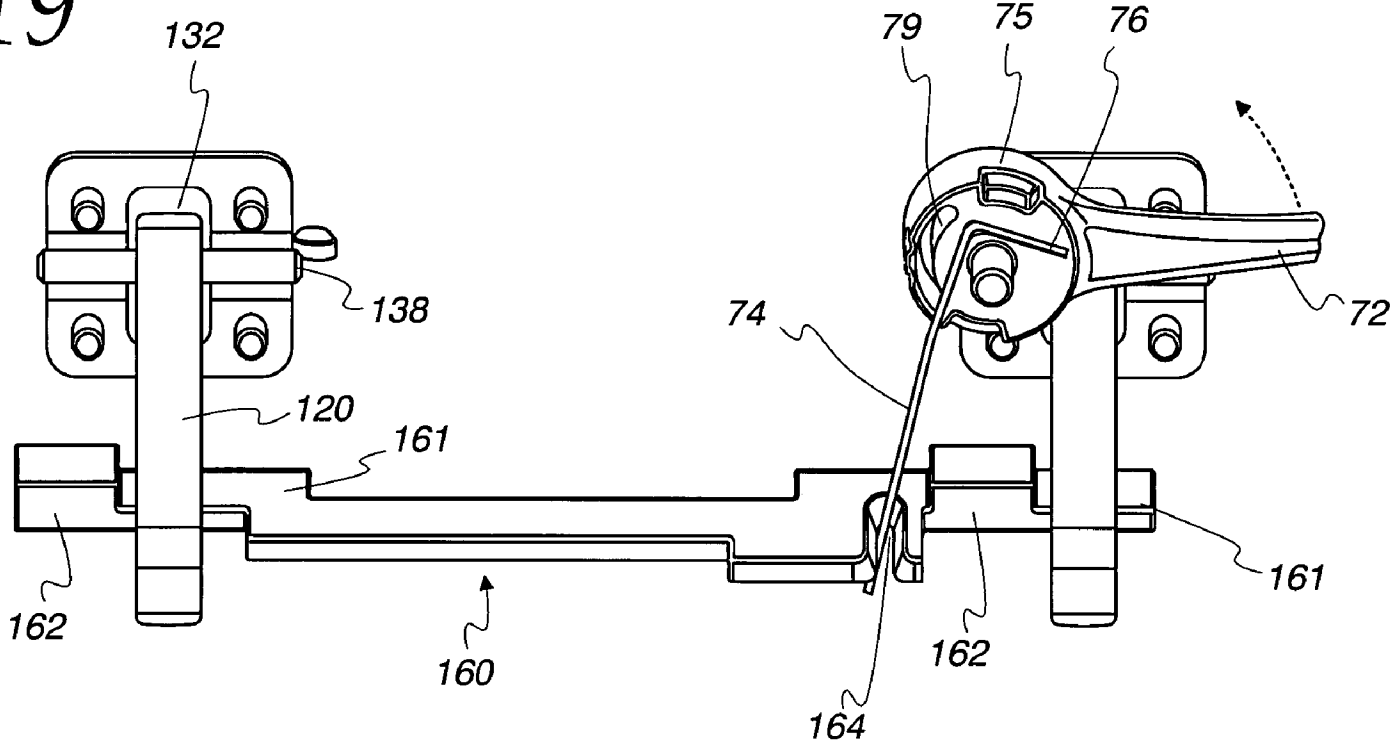
FIG. 19 is a bottom view of the operating assembly of the invention.
Figure 20:
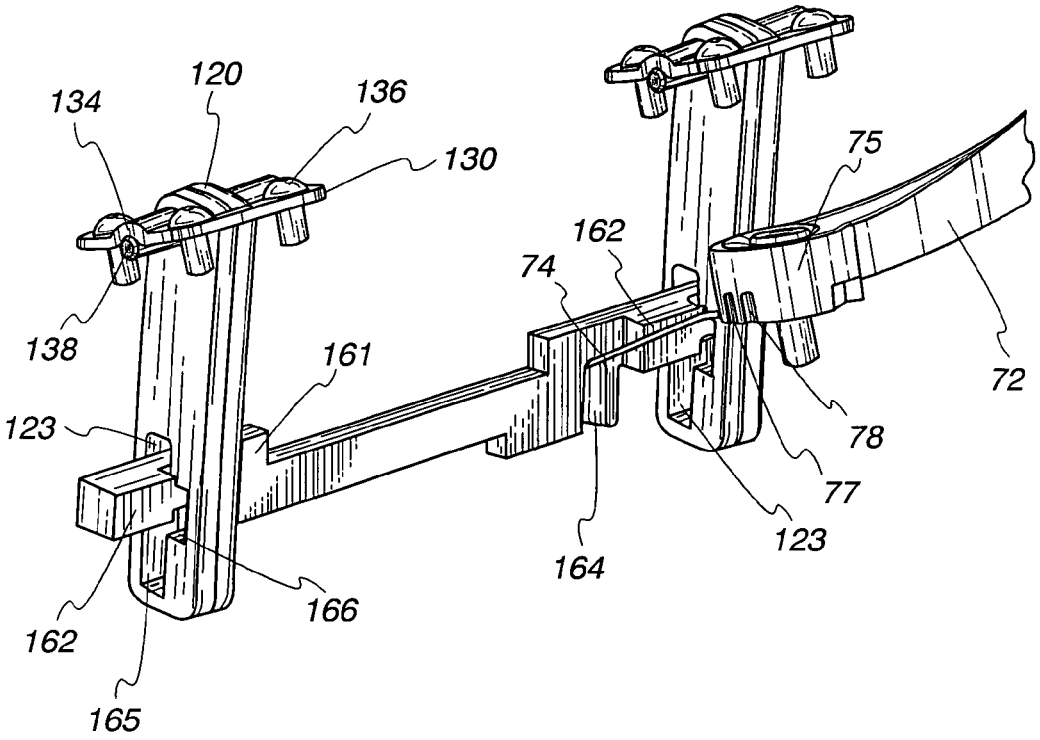
FIG. 20 is a perspective view showing the lock member, the lock engagement member, and the operating assembly.
Figure 21:
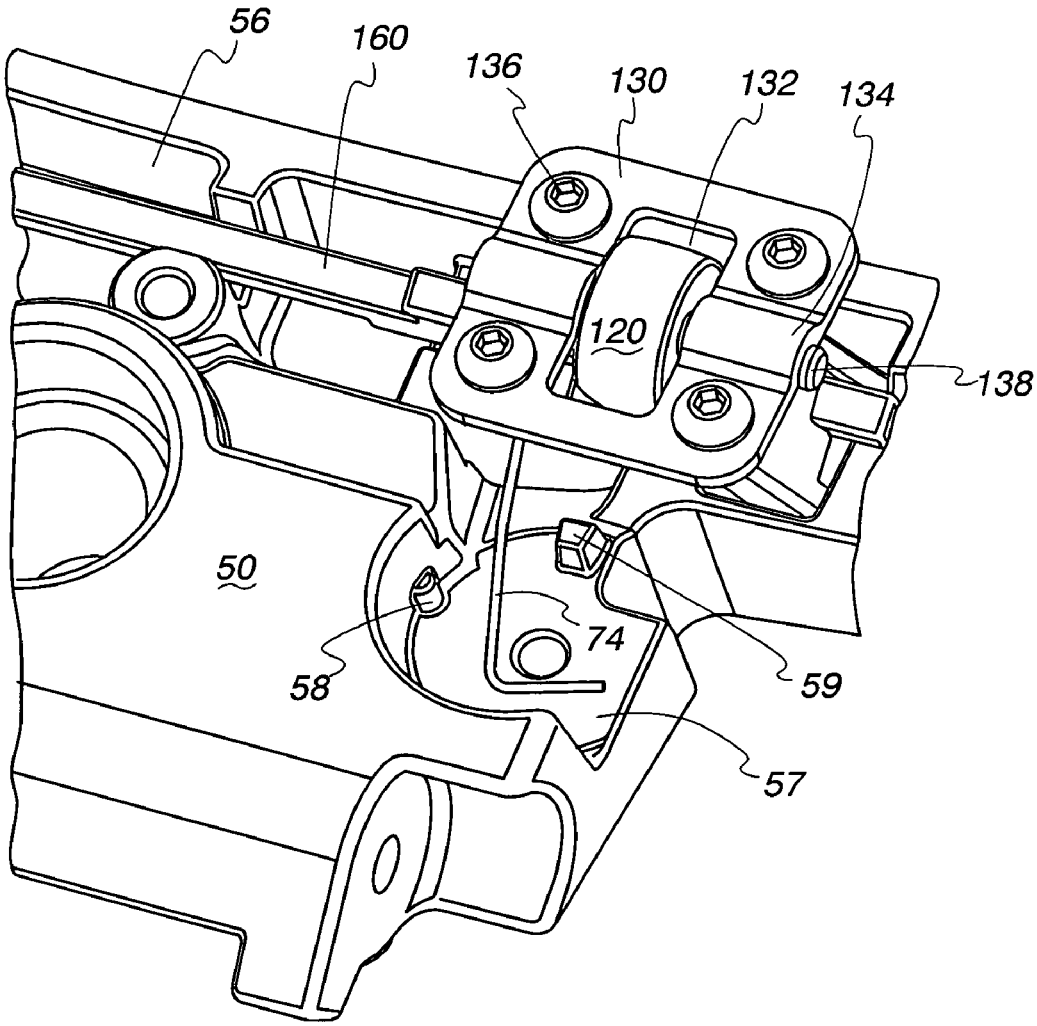
FIG. 21 is a view similar to FIG. 18 but with the tilt lock lever removed.

FIG. 18 illustrates the second embodiment of the inventive tilt lock assembly in the unlocked condition. Lock engagement member 160 is within channel 156. Tilt lock lever 72 is operatively engaged to spring wire 74, which is engaged in slot 164 of lock engagement member 160. Lock engagement member 160 has a wider portion 162 which is not engaged in lock member 120, and a narrower portion 161 which is engaged with lock member 120 by passing through aperture 123. Referring to FIG. 19, the underside of tilt lock lever 72 includes a slot 76 that receives one end of spring wire 74. In the illustrated embodiment slot 76 is "L" shaped, although other suitable shapes can be used. As shown in FIG. 19, when the tilt lock lever 72 is unlocked position, the opposite end of spring wire 74 is urged against one side of notch 164 of lock engagement member 160, urging wider portions 162 away from lock members 120. When tilt lock lever 72 is moved to the lock position, as shown by the dotted arrow, then spring wire 72 will be urged against the opposite side of notch 164, urging wider portions 162 of lock engagement member 160 toward lock members 120. As seen in FIG. 20, T-shaped apertures 123 of lock members 120 have a main channel 165 and an associated channel 166. Thinner portions 161 fit within the entire length of main channel 165, so that lock member 120 can move vertically as the seat assembly 18 pivots. When the wider portions 162 of lock engagement member 160 are aligned with associated channels 166, and the lock lever 72 is in the lock position, then spring wire 74 will urge the wider portions 162 of lock engagement member 160 into the associated channels 166 of apertures 123. When lock engagement member 160 is so engaged, it will prevent vertical movement of lock members 120, and thereby prevent any tilting of seat assembly 18. If seat assembly 18 is operatively engaged with back assembly 17, such as in a synchro-tilt chair, then back assembly 17 also will be prevented from tilting.

Tilt lock lever 72 is mounted to hub member 50 at pivoting end 75. As shown in FIG. 20, the outer circumference of pivoting end 75 is provided with two indentations 77, 78. Pivoting end 75 is seated within well 57 of hub member 50. S shown in FIG. 21, well 57 has a boss 58 and a stop 59. When lock lever 72 is in the unlocked position, then boss 58 engages indentation 77. When lock lever 72 is rotated into the locked position, then boss 58 engages indentation 78. On the underside of pivoting end 75 and behind indentations 77 and 78 is an arcuate channel 79, shown in FIG. 19. The purpose of the arcuate channel 79 is to create a yieldable wall in pivoting end 75 behind indentations 77, 78, so that the yieldable wall of the pivoting end will flex as the lock lever rotates between the unlocked and locked positions. Also within well 57 is stop 59, which prevents over-rotation of lock member 72.

It will be appreciated that while the specifics of the construction of the lock lever 72, spring wire 74, and hub member 50 have been set forth with respect to the second embodiment of the invention, such constructions are also applicable to the first embodiment of the invention described above.

There have been described two embodiments of a tilt lock mechanism of the invention. Those skilled in the art will recognize that other embodiments can be made using equivalents of the disclosed embodiments, and such equivalents are intended to be within the scope of the claims appended hereto.

What is claimed is:

1. A chair comprising a seat frame, a central support member that fixedly supports said seat frame, a seat assembly tiltably mounted to said seat frame, a lock member operatively connected to said seat assembly and in sliding engagement with said seat frame, a lock engagement member operatively secured to said seat frame and in operative relation to said lock member, and an operating lever for operating said lock engagement member between an unlocked condition and a locked condition, said operating lever being movable between a lock position and an unlock position, and a means for connecting said operating lever and said lock engagement member, said connecting means being a biasing means that biases said lock engagement member toward its unlocked position when said operating lever is in its unlock position, and biases said lock engagement member toward its locked position when said operating lever is in the lock position, whereby when said lock engagement member is in an unlocked condition, said seat assembly can move through its range of tilting motion while said lock member slides with respect to said seat frame, and when said lock engagement member is in the locked condition, it engages said lock member such that said lock member does not slide with respect to said seat frame, said seat assembly thereby being restrained from tilting, said operating lever being movable to assert a biasing force through said biasing means to urge said lock engagement member toward said lock member at any tilt position of said seat assembly, said biasing force causing said lock engagement member to move into locking engagement with said lock member when said seat assembly is moved through its range of tilting motion to an untilted position.

2. The chair of claim 1 wherein said lock member comprises an aperture and said lock engagement member is operated between the locked and unlocked condition by moving through said aperture.

3. The chair of claim 2 wherein said aperture comprises a main channel and an associated channel, such that said lock engagement member is disposed through said main channel in the unlocked condition, and said lock engagement member engages said associated channel in the locked condition.

4. The chair of claim 3 wherein said lock engagement member comprises a thinner portion and a thicker portion and said thicker portion engages said associated channel when in the locked condition.

5. The chair of claim 1 wherein said biasing means is a spring wire.

6. The chair of claim 1 wherein said operating lever is pivotably mounted to said seat frame.

7. The chair of claim 6 wherein said operating lever comprises two indentations and said seat frame comprises a boss in operative relation to said indentations, such that said boss engages one of said indentations when said operating lever is in the unlock position, and said boss engages the other of said indentations when said operating lever is in the unlock position.

8. The chair of claim 7 wherein said lock member comprises an upper portion and a lower portion in sliding engagement with one another.

9. The chair of claim 1 further comprising a second lock member operatively connected to said seat assembly and in sliding engagement with said seat frame, said lock engagement member further being in operative relation to said second lock member.

10. The chair of claim 1 wherein said chair is a synchro-tilt chair.

* * * * *

UNITED STATES PATENT AND TRADEMARK OFFICE

CERTIFICATE OF CORRECTION

PATENT NO. : 7,066,538 B2
APPLICATION NO. : 10/749009
DATED : June 27, 2006
INVENTOR(S) : Jay R. Machael et al.

It is certified that error appears in the above-identified patent and that said Letters Patent is hereby corrected as shown below:

In Col. 8, line 10, delete “unlock” and insert --lock--.

Signed and Sealed this
Nineteenth Day of June, 2012

David J. Kappos

David J. Kappos
*Director of the United States Patent and Trademark Office*